United States Patent [19]

Alford

[11] Patent Number: 4,987,818

[45] Date of Patent: Jan. 29, 1991

[54] SHAPING APPARATUS FOR AN EXPLOSIVE CHARGE

[76] Inventor: Sidney C. Alford, 41A Pickwick, Corsham, Wiltshire, England, SN13 0HX

[21] Appl. No.: 355,607

[22] Filed: May 23, 1989

[51] Int. Cl.[5] ..... C06B 21/00; F42B 4/00; F42B 1/00; F42B 1/02

[52] U.S. Cl. ..... 86/1.1; 86/20.1; 86/20.15; 102/307; 102/309; 102/314; 102/332; 102/476; 264/3.1; 264/3.4; 175/4.6

[58] Field of Search ..... 86/1.1, 20.14, 20.15, 86/20.1; 102/306, 307, 309, 314, 332, 476, 318; 175/4.6

[56] References Cited

U.S. PATENT DOCUMENTS

| | | | |
|---|---|---|---|
| 3,302,567 | 2/1967 | Venghiattis | 102/307 |
| 3,736,875 | 6/1973 | Bucklishch | 102/306 |
| 4,109,576 | 8/1978 | Eckels | 102/307 |
| 4,220,687 | 9/1980 | Christopher | 428/546 |
| 4,342,261 | 8/1982 | Majerus | 102/307 |
| 4,387,773 | 6/1983 | McPhee | 102/476 |
| 4,450,768 | 5/1984 | Bell | 102/307 |
| 4,627,353 | 12/1986 | Chawla et al. | 102/307 |
| 4,669,384 | 2/1987 | Chawla et al. | 102/307 |
| 4,759,886 | 7/1988 | Daugherity | 264/3.1 |
| 4,794,990 | 1/1989 | Riggs | 102/306 |

*Primary Examiner*—Howard J. Locker
*Attorney, Agent, or Firm*—Finnegan, Henderson, Farabow, Garrett & Dunner

[57] ABSTRACT

The invention provides shaping apparatus for an explosive charge, particularly for use with plastic explosive in forming shaped charges. The shaping apparatus comprises a hollow cylindrical body (1), a substantially conical partition (2) within said body for shaping an explosive charge (3) inserted into the body on one side of said partition (2) and means (5) on the other side of said partition (2) for supporting a detonator (6).

13 Claims, 1 Drawing Sheet

SHAPING APPARATUS FOR AN EXPLOSIVE CHARGE

Figure 1:
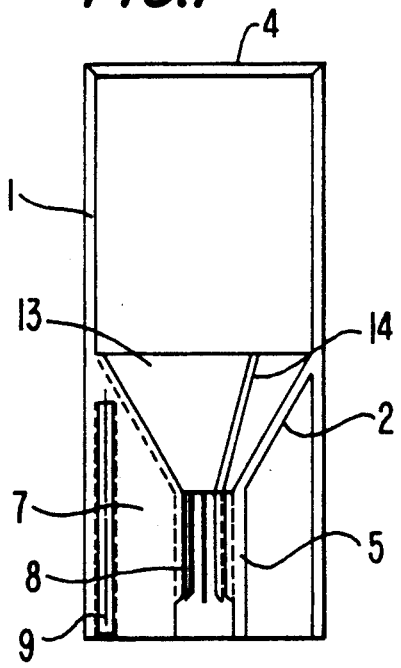

This invention relates to shaping apparatus for explosive charges.

In the field of explosives engineering, it is sometimes required to make a hole of controlled dimensions in a target by remote means, e.g. to vent a gas or liquid or to pass a securing cable. Likewise, in research and development involving the use of explosive charges, for example, in developing shaped charge liners or in assessing the resistance of targets to explosive forces, it is often necessary to make up a series of charges in which one or more parameters is varied. Sometimes one or more of these functions needs to be performed under water.

The present invention has as its object to provide shaping apparatus for an explosive charge which will enable shaped charges to be produced in a simple and convenient manner, e.g. for use in the kinds of situations exemplified above.

The present invention provides shaping apparatus for an explosive charge, the shaping apparatus comprising a hollow cylindrical body, a substantially conical partition within said body for shaping an explosive charge inserted into the body from one end thereof on one side of said partition and means on the other side of said partition for supporting a detonator.

The term "substantially conical" as used herein and in the claims hereof means conical, frusto-conical or any other similar axi-symmetrical form suitable for shaping an explosive charge. Preferably the partition is frusto-conical.

Said partition may be provided at an intermediate position along the length of said body, is preferably watertight, and is preferably integral with said body.

Said detonator supporting means may be adapted to support a tubular detonator so that the detonator extends substantially coaxially of the body from adjacent the apex of said partition. For example, said detonator supporting means may comprise a sleeve or passage coaxial with the body into which a said detonator can be inserted. The said sleeve or passage may have longitudinally extending ribs on the internal surface thereof for frictionally engaging a said detonator inserted therein. The detonator supporting means may be supported within said body by radially-extending spider members and such spider members may be in the form of web portions which also provide support for said partition. The detonator supporting means and said spider members may be integral with said body and said partition.

The said partition may have ribs or other projections on the internal conical surface thereof to provide a key for plastic explosive pressed against said surface and shaped thereby.

The apparatus may have connecting means whereby at least one leg or other support can be connected thereto. Such means may comprise, for example, at least one tubular portion into which one end of a wire leg can be inserted. Said at least one tubular portion may be on said other side of said partition and may extend longitudinally of said body adjacent the internal surface thereof. According to a preferred embodiment a said tubular portion is formed integrally with each of said web portions forming said spider members. The or each said leg may be formed from an aluminium or other malleable wire which can be manually bent to position the shaping apparatus as required. The or each said leg may incorporate magnetic means whereby the shaping apparatus can be attached to a suitable surface, e.g. to the surface of a ferrous target.

Closure means may be provided for closing said one end of said body. Such closure means may be in the form of a cap or plug which fits over or in said one end of said body and which preferably provides a watertight seal to prevent water coming into contact with explosive material inserted into the body or, more importantly, fitting the air space within the body.

The shaping apparatus of the present invention is preferably formed, e.g. moulded, from a suitable plastics material. This has the advantages that the apparatus can be light in weight, relatively inexpensive to produce and minimises danger from flying fragments when an explosive charge contained within the body is detonated.

The apparatus of the present invention may comprise a liner, disc or other insert which can be inserted into said body from said one end thereof after a said explosive charge has been inserted therein. Said liner may, for example, be substantially conical. Said liner, disc or other insert may be of metal, plastics or other suitable material.

The apparatus of the present invention may further comprise a mandrel for use in inserting an explosive charge into said body. The said mandrel may have an end portion shaped to impart a required shape to an explosive charge inserted into said body and/or may be hollow and comprise or contain or contain means for volumetrically measuring explosive material.

The apparatus of the present invention is particularly intended for use with plastic explosive materials, although it can be used with other explosives such as explosive powders which can be pressed into said body. Although the apparatus of the present invention could be supplied with an explosive charge already contained within said body, it is anticipated that most people who would use the apparatus would already have a supply of plastic explosive and detonators to hand and that the apparatus would be supplied without the explosive charge and without a detonator and that these would be inserted by the user. This makes the apparatus safe to store and to transport and means that the apparatus could even be sent in the mail if required.

Figure 3:
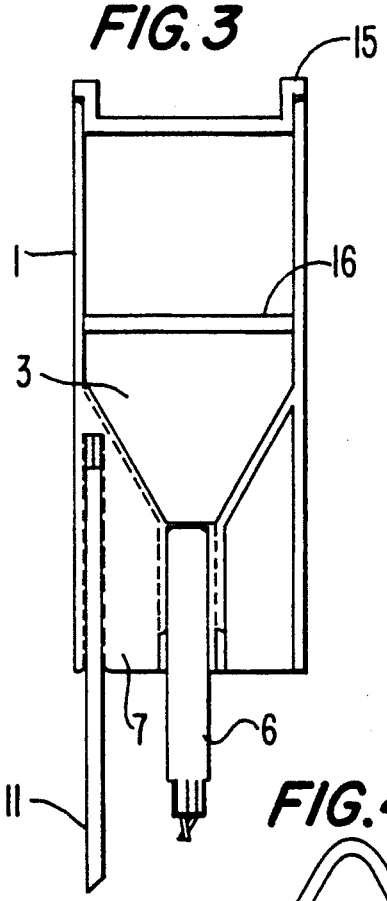
Figure 2:
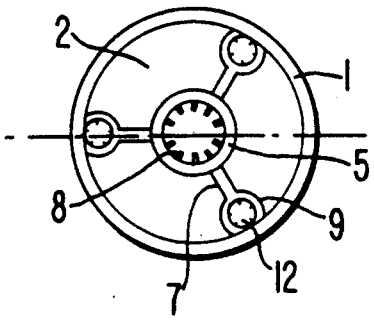
Figure 4:
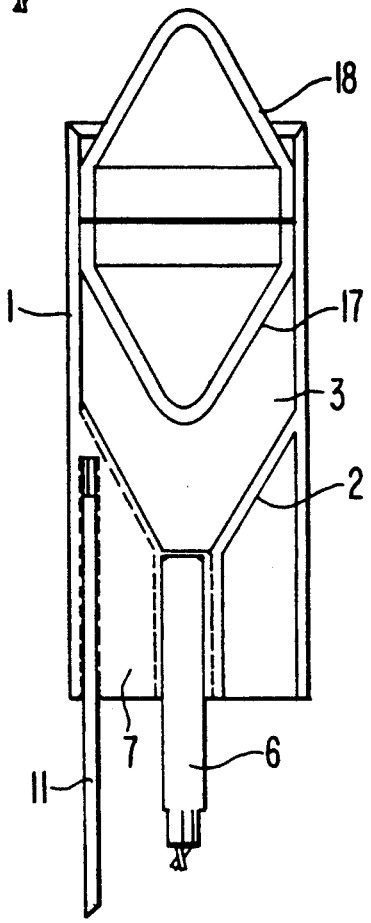

The invention will be more particularly described with reference to the accompanying drawings, in which:

FIG. 1 is a sectional elevation of one embodiment of shaping apparatus according to the present invention, FIG. 2 is an end elevation of the apparatus of FIG. 1, FIG. 3 is a sectional elevation of the apparatus of FIG. 1 prepared for use as an explosive charge, and FIG. 4 is another sectional elevation of the apparatus of FIG. 1 prepared for use in a different manner.

Referring to FIGS. 1 and 2 of the drawings, it will be seen that the shaping apparatus illustrated therein comprises a moulded plastics hollow cylindrical body 1 having an integral frusto-conical partition 2 therein for shaping an explosive charge 3 (FIGS. 3 and 4) inserted therein through the open end 4 of the body 1. A sleeve 5 for supporting a tubular detonator 6 (FIGS. 3 and 4) extends coaxially of the body 1 from the apex of the partition 2, the inner end of the sleeve 5 being closed by the partition 2. The sleeve 5 is supported within the body 1 by radially-extending spider members in the form of web portions 7 which also serve to support the partition 2 and which are formed integrally with the body 1, partition 2 and sleeve 5. The sleeve 5 has deformable ribs 8 on the internal surface thereof for frictionally engaging a detonator 6 inserted into the sleeve 5.

Formed integrally with the web portions 7 are tubular portions 9 for receiving one end of one or more wire legs 11 (FIGS. 3 and 4). The tubular portions 9 may have deformable ribs 12 extending longitudinally of the internal surface thereof for frictionally engaging the end of a leg 11 inserted therein. The or each leg 11 may be formed from an aluminium or other malleable wire which can be manually bent to support the shaping apparatus in a required position or to form a required support such as a single leg, double leg or tripod support.

The internal surface 13 of the partition 2 may have ribs 14 or other projections thereon to provide a key for a plastic explosive inserted into the body 1 and shaped by the partition 2.

Referring now to FIG. 3, it will be seen that an explosive charge utilising the shaping apparatus of FIGS. 1 and 2 comprises a charge of plastic explosive inserted into the body 1 through the open end 4 thereof, a detonator 6 inserted into the sleeve 5 and a leg support 1 inserted into one of the tubular portions 9. The open end 4 of the tubular body 1 is closed by a closure member 15 which may be sealed by means of an O-ring seal or by applying a suitable sealing material, such as a silicon rubber sealing mastic, therearound. If desired a disc or flyer plate 16, e.g. of copper or other metal or of plastics or other material may be inserted in the body 1 after the plastic explosive 3 has been inserted therein and before the closure member 15 is applied.

The embodiment of FIG. 4 is substantially the same as the embodiment of FIG. 3 except that the disc 16 has been replaced by a substantially conical liner 17, e.g. of metal or plastics, which serves to further shape the plastic explosive 3 and the open end of the body 1 has been closed by a similar liner 18 which has been reversed. The liner 18 may be sealed by applying a suitable sealing mastic therearound. Liners of other shapes or inserts of any kind for any required or particular purpose can be used with the apparatus of the present invention as desired.

It will be understood that with the body 1 suitably closed and sealed as by means of the closure 15 or liner 18, the explosive charge is suitable for use under water since the body 1 is prevented from filling with water and the explosive charge 3 is protected from the ingress of water by the closure on the one hand and the partition 2 on the other.

If desired, a plurality of explosive charges utilising the shaping apparatus of the present invention can be linked together for detonation either substantially simultaneously or in series. If substantially simultaneous detonation is required then it is preferred that the explosive charges are connected by detonating cord, although they can if desired be detonated electrically or otherwise.

I claim:

1. Shaping apparatus for an explosive charge, the shaping apparatus comprising a hollow cylindrical body open at each end, a frusto-conical integrally formed partition at an intermediate position within said body for shaping an explosive charge inserted into the body from one end thereof on a concave side of said partition, sleeve means on the convex side of and integral with said partition for supporting a tubular detonator, said sleeve means extending coaxially within said body from an apex of said frusto-conical partition, and radially extending support members between said body and said sleeve means for supporting said sleeve means within said body.

2. Shaping apparatus according to claim 1, wherein said partition is watertight.

3. Shaping apparatus according to claim 1, wherein said sleeve means has longitudinally extending ribs on the internal surface thereof for frictionally engaging said detonator inserted therein.

4. Shaping apparatus according to claim 1, wherein said support members are in the form of web portions which also provide support for said partition and which with said sleeve means are formed integrally with said body and said partition.

5. Shaping apparatus according to claim 1, wherein said partition has projections on the concave surface thereof.

6. Shaping apparatus according to claim 4, having means for connecting at least one leg to said body.

7. Shaping apparatus according to claim 1, wherein said connecting means comprises at least one tubular portion into which one end of a wire leg can be inserted, said at least one tubular portion extending longitudinally of said body adjacent an internal surface thereof and being formed integrally with one of said web portions.

8. Shaping apparatus according to claim 7, wherein at least one said leg is constructed for manual bending to permit selective positioning of the shaping apparatus.

9. Shaping apparatus according to claim 1, comprising closure means for closing an end of said body on the concave side of said partition.

10. Shaping apparatus according to claim 1, molded from a plastics material.

11. Shaping apparatus according to claim 1, comprising an insert for insertion into said body from an end thereof on the concave side of said partition after a said explosive charge has been inserted therein with the explosive charge being positioned between said partition and said insert.

12. Shaping apparatus according to claim 11, wherein said insert is substantially conical.

13. Shaping apparatus according to claim 11, wherein said insert is of metal or plastics material.

* * * * *

UNITED STATES PATENT AND TRADEMARK OFFICE

CERTIFICATE OF CORRECTION

PATENT NO. : 4,987,818

DATED : January 29, 1991

INVENTOR(S) : Sidney C. Alford

It is certified that error appears in the above-identified patent and that said Letters Patent is hereby corrected as shown below:

Claim 7, line 1 column 4, line 33, change "claim 1" to --claim 6--.

Signed and Sealed this

Twenty-eighth Day of July, 1992

*Attest:*

DOUGLAS B. COMER

*Attesting Officer*

*Acting Commissioner of Patents and Trademarks*